US005595099A

United States Patent [19]

Pusateri

[11] Patent Number: 5,595,099

[45] Date of Patent: Jan. 21, 1997

[54] STRESS REDUCED PINNED ANVIL AND SOCKET TOOL

[75] Inventor: Daniel S. Pusateri, Grayslake, Ill.

[73] Assignee: Snap-on Technologies, Inc., Crystal Lake, Ill.

[21] Appl. No.: 460,916

[22] Filed: Jun. 5, 1995

[51] Int. Cl.[6] ..... B25B 23/16

[52] U.S. Cl. ..... 81/177.85; 279/97

[58] Field of Search ..... 81/177.2, 177.85; 279/97; 403/294, 324, 408

[56] References Cited

U.S. PATENT DOCUMENTS

| | | | |
|---|---|---|---|
| 471,765 | 3/1892 | Wever et al. . | |
| 897,055 | 8/1908 | Bowers . | |
| 1,398,054 | 11/1921 | Abegg . | |
| 2,147,163 | 2/1939 | Jimerson . | |
| 2,464,381 | 3/1949 | Donaldson et al. . | |
| 2,700,549 | 1/1955 | Cornett . | |
| 2,801,860 | 8/1957 | Getts | 279/97 |
| 2,890,072 | 6/1959 | Kaman et al. . | |
| 3,726,533 | 4/1973 | Lafferty | 279/97 |
| 4,266,453 | 5/1981 | Farley . | |
| 4,535,658 | 8/1985 | Molinari . | |
| 4,699,029 | 10/1987 | Kelly et al. . | |
| 4,832,546 | 5/1989 | Potemkin . | |
| 5,172,612 | 12/1992 | Hansson . | |
| 5,317,894 | 6/1994 | Southhard . | |
| 5,361,656 | 11/1994 | Starr . | |
| 5,438,894 | 8/1995 | Pearce | 81/177.85 X |

OTHER PUBLICATIONS

Armstrong Bros. Tool Co.; Catalog No. 57; "drive parts" section items adapters & extension bars Dec 1957.

*Primary Examiner*—James G. Smith
*Attorney, Agent, or Firm*—Emrich & Dithmar

[57] ABSTRACT

An impact power tool has a drive anvil with a square drive lug at one end thereof provided with a peripheral groove formed therein adjacent to its distal end. A socket tool body has a square socket receptacle mateable with the drive lug and defining flat planar drive surfaces. A bore extends transversely through the socket body and the receptacle substantially tangent to one of the surfaces so as to communicate with the groove when the drive lug is received in the receptacle while being retained in place by a pin receivable through the bore and the groove. Extension and adapter socket tools are disclosed.

19 Claims, 2 Drawing Sheets

Fig. 5
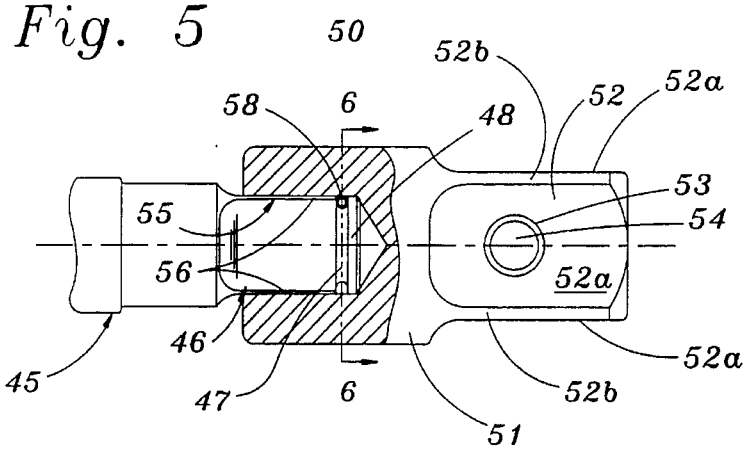
Fig. 6
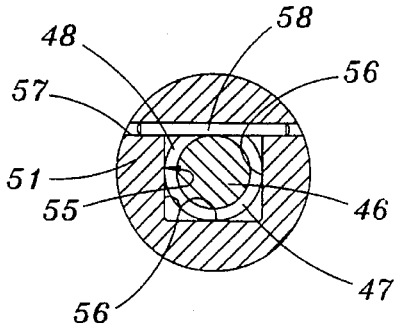
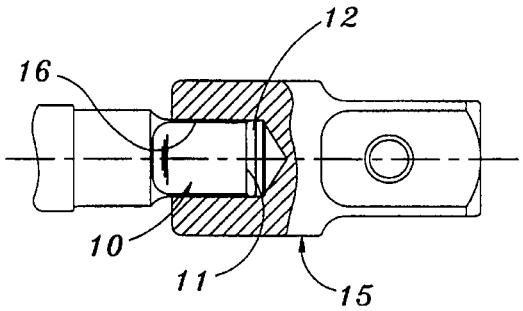
Fig. 2
(Prior Art)
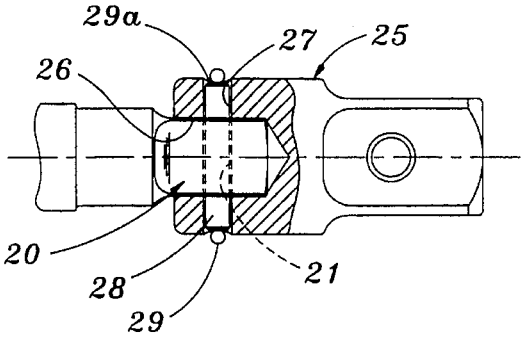
Fig. 3
(Prior Art)
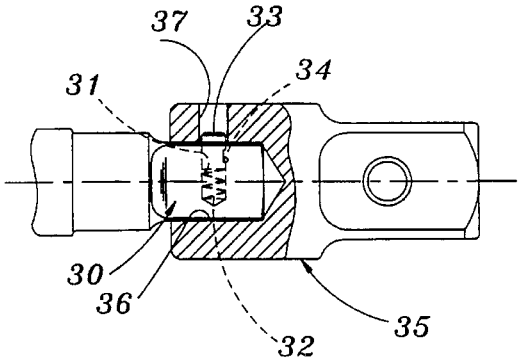
Fig. 4
(Prior Art)

STRESS REDUCED PINNED ANVIL AND SOCKET TOOL

BACKGROUND OF THE INVENTION

1. Field Of the Invention

The present invention relates to power-driven tools, such as wrenches and, in particularly, to arrangements for retaining socket tools on the drive anvils of such power tools.

2. Description of the Prior Art

Several different techniques are commonly used for retaining socket tools on the drive anvil of a power tool, such as a pneumatically-driven impact wrench. These techniques are illustrated in FIGS. 2–4 of the drawings. As used herein, the term "socket tool" encompasses any tool adapted to mateably engage the drive anvil, such as socket wrenches, adapters, extensions and the like. While an adapter is shown in FIGS. 2–4 for purposes of illustration, the same principles apply to other types of socket tools.

One common arrangement, illustrated in FIG. 2, includes an anvil drive lug 10 having a peripheral groove 11 formed adjacent to the distal end thereof, in which a wire ring or rubber O-ring 12 is seated. The drive lug 10 is typically square in transverse cross section, but could have other shapes. The socket tool 15 has a socket receptacle 16 therein, typically square in transverse cross section, which mateably receives the anvil drive lug 10. The ring 12 provides a friction fit to frictionally retain the socket tool 15 on the anvil lug 10. This arrangement permits the socket tool 15 to be easily mounted on and removed from the anvil lug 10. However, there are many applications which require a permanent or semi-permanent installation of the socket tool on the anvil drive lug, and the arrangement of FIG. 2 would not be suitable for such applications. Furthermore, the ring 12, which is frequently formed of an elastomeric material such as a suitable rubber, tends to wear out and must be frequently replaced. Furthermore, this arrangement will not reliably retain heavy sockets.

In FIG. 3 there is illustrated another prior art arrangement in which an anvil drive lug 20 has a cylindrical bore 21 formed transversely therethrough substantially perpendicular to opposite faces thereof. The socket tool 25 has a socket receptacle 26, and a cylindrical bore 27 formed diametrically therethrough. The anvil drive lug 20 is inserted in the socket receptacle 26 with the bores 21 and 27 in alignment for receiving therethrough a retaining pin 28, which is retained in place by means of an O-ring 29 seated in a circumferential groove **29*a* in the outer surface of the socket tool 25. The pin 28 can be tapped out of the bores 21 and 27 after removal of the O-ring 29** to disengage the parts.

FIG. 4 discloses another prior art arrangement in which the anvil drive lug 30 has a bore 31 formed centrally in one of the faces of the drive lug perpendicular thereto and receives therein a compression spring which outwardly biases a detent pin 33, which may be retained against expulsion by a retaining pin 34 or other well-known retaining means. The socket tool 35 has a socket receptacle 36 with a radial bore 37 in the tool 35 which communicates with the receptacle 36 and receives therein the detent 33 when the anvil drive lug 30 is inserted in the socket receptacle 36, for retaining the parts in an engaged condition. For disengagement the detent pin 33 may be depressed by inserting a suitable object in the bore 37.

Each of the arrangements of FIGS. 3 and 4 affords an effective permanent or semi-permanent coupling of the parts. However, it has been found that the bores formed in the anvil drive lugs 20 and 30 severely weaken those lugs. Indeed, impact wrench life testing has shown an 80% decrease in the life of the anvils 20 and 30 as compared with a non-bored anvil, such as the anvil drive lug 10. If a drive lug fails it must be replaced. This is a significant inconvenience, since it requires replacement of the entire anvil which, as can be seen in FIG. 1 (described below), is many times larger than the drive lug itself. Thus, the anvil itself is relatively expensive and its replacement requires disassembly of the associated power tool.

SUMMARY OF THE INVENTION

It is a general object of the invention to provide an improved socket tool retention arrangement which avoids the disadvantages of prior retention arrangements while affording additional structural and operating advantages.

An important feature of the invention is the provision of the socket tool which can be permanently or semi-permanently retained on an anvil drive lug without significantly weakening the drive lug.

In connection with the foregoing feature, another feature of the invention is the provision of a socket tool of the type set forth which is pinned in place on the associated anvil.

Yet another feature of the invention is the provision of a combination of a power tool anvil drive lug and an associated socket tool and an apparatus for effectively retaining them in an engaged condition without unduly stressing the drive lug.

Certain ones of these and other features of the invention are attained by providing a socket tool comprising: a body having a socket receptacle formed therein, the receptacle being non-circular in transverse cross section, and a bore extending transversely through the body and intersecting the receptacle.

Further features of the invention are obtained by providing in combination: a power impact tool including a drive anvil having an anvil drive lug at one end thereof non-circular in transverse cross section, the anvil drive lug having a peripheral groove formed therein adjacent to a distal end thereof; a socket tool including a body having a socket receptacle formed therein, the receptacle being shaped and dimensioned to mateably receive the anvil drive lug therein in driving engagement therewith, and a bore extending transversely through the body and intersecting the receptacle so as to communicate with the groove when the anvil drive lug is received in the receptacle; and a pin receivable through the bore and the groove for retaining the socket tool on the anvil.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 2 is a fragmentary side elevational view, in partial section, showing a prior art tool engaged on a prior art anvil drive lug;

FIG. 3 is a view similar to FIG. 2, illustrating another prior art arrangement for coupling a socket tool to an anvil drive lug;

FIG. 4 is a view similar to FIG. 2, illustrating another prior art arrangement for coupling a socket tool to an anvil drive lug;

FIG. 5 is an enlarged view similar to FIG. 2, showing a socket tool in accordance with the present invention engaged on an anvil drive lug of the power tool FIG. 1;

FIG. 6 is a view in vertical section taken along the line 6—6 in FIG. 5;

DESCRIPTION OF THE PREFERRED EMBODIMENTS

Figure 1:
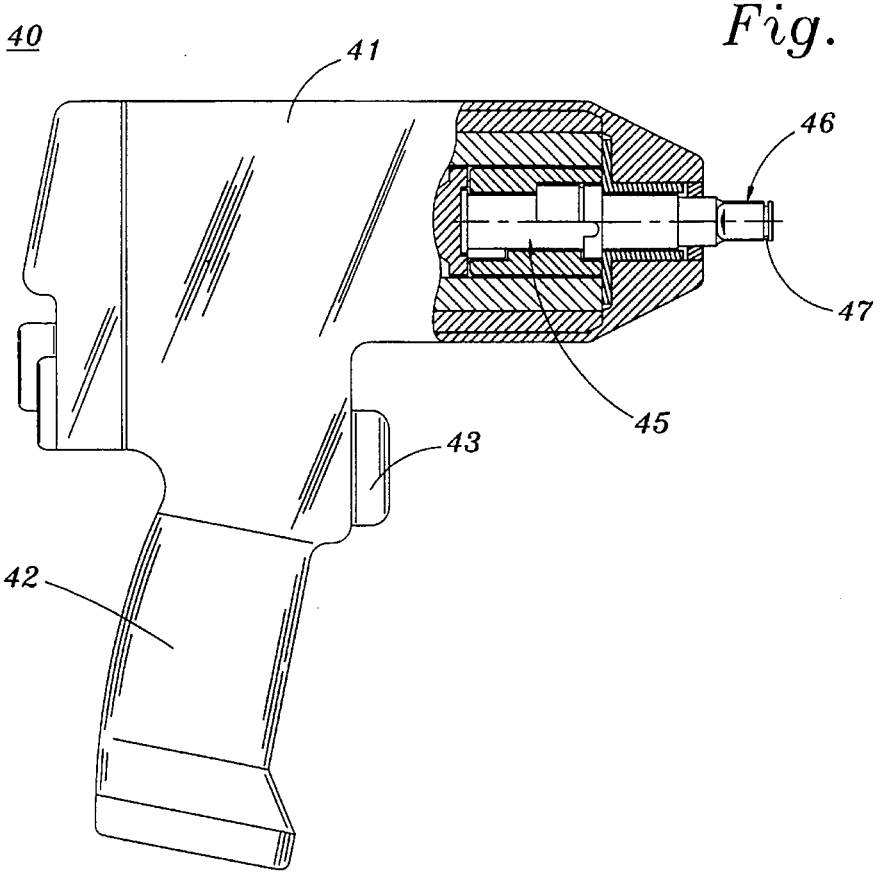
FIG. 1 is a side elevational view of a pneumatically-operated impact wrench, shown in partial section to illustrate the drive anvil in accordance with the present invention.

Referring to FIG. 1, there is illustrated a power tool 40, which may be a pneumatically-driven tool, such as a impact wrench. The power tool 40 has a housing 41 and a handle 42 provided with a trigger 43 for controlling operation of the tool. The tool 40 may be provided with an air motor and hammer mechanism of known construction for operating an anvil 45, which is provided with a square drive 46 at one end thereof projecting forwardly from the housing of 41, all in a known manner. Referring also to FIGS. 5 and 6, the drive lug 46 has a circular distal end 48 and is provided with a circumferential groove 47 around the periphery thereof.

Figure 7:
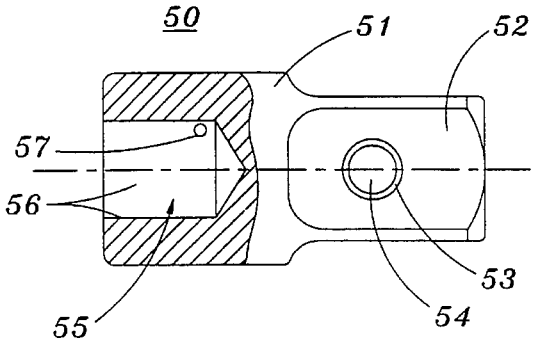
FIG. 7 is a side elevational view in partial section of the socket tool of FIG. 5.

Referring to FIGS. 5 and 7, the present invention includes a socket tool 50 having an elongated body 51 provided at one end thereof with a square drive lug 52 with four flat, planar drive faces **52*a* having the corners thereof chamfered or beveled, as at 52*b*. Formed in one of the faces 52*a* substantially centrally thereof and perpendicular thereto is a cylindrical bore 53, in which is seated a detent pin 54 which is spring biased to a normal projecting position in the same manner as described above in connection with the prior art drive lug 30 of FIG. 4. Formed in the other end of the body 51 is a square socket receptacle 55 defining four flat, planar drive surfaces 56 and dimensioned to mateably receive therein the anvil drive lug 46. Formed transversely through the body 51 along a chord thereof is a cylindrical bore 57, positioned to pass through the socket receptacle 55 substantially tangent to one of the flat surfaces 56, as can best be seen in FIGS. 5 and 6. Preferably, the bore 57 has a radius slightly less than that of the peripheral groove 47 in the anvil drive lug 46. The socket receptacle 55 is formed substantially coaxial with the square drive lug 52 and the bore 57 is positioned closely adjacent to the inner end of the socket receptacle 55, so as to intersect the groove 47 when the anvil drive lug 46 is fully inserted in the socket receptacle 55, as shown in FIG. 5**.

The invention further includes a cylindrical pin 58, slidably frictionally receivable in the bore 57 and through the groove 47 in the anvil drive lug 46 for retaining the socket tool 50 on the anvil drive lug 46 in the engaged condition illustrated in FIG. 5. When it is desired to disengage the socket tool 50 from the anvil drive lug 46, the pin 58 may be driven from the bore 57 by the use of a suitable instrument.

It will be appreciated that the present invention provides a permanent or semi-permanent coupling between the socket tool 50 and the anvil drive lug 46 without weakening the anvil drive lug 46 or creating any undue stress concentration points therein. Furthermore, the socket tool 50 of the present invention is readily adapted for use with the prior art anvil drive lug 10 of FIG. 2 by simply removing the ring 12. Furthermore, the socket tool 50 of the present invention could be produced by modifying the prior art socket tool 15 by simply providing the bore 57 at the appropriate location.

For purposes of illustration, the socket tool 50 has been shown as an adapter, wherein the socket receptacle 55 is smaller than the square drive lug 52. Thus, the socket tool 50 may be used for adapting, e.g., a ½-inch square drive power tool anvil to a ¾-inch square drive associated socket tool (not shown).

Figure 8:
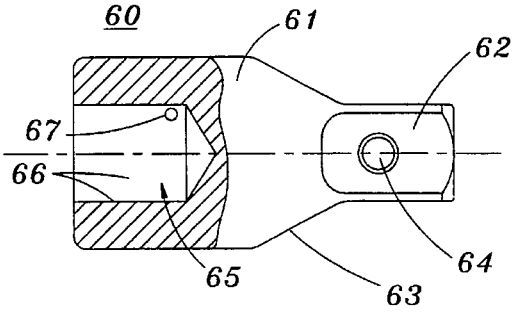
FIG. 8 is a view similar to FIG. 7 of another configuration of an extension tool in accordance with the present invention.

Referring to FIG. 8, there is illustrated another form of the present invention comprising a socket tool 60 in the form of a short extension having a body 61 provided with a square drive lug 62 at one end thereof, the drive lug 62 being coupled by a frustoconical portion 63 to the main portion of the body 61. A detent pin 64 is provided in one face of the square drive lug 62 in the same manner as was described above in connection with the socket tool 50. Formed axially in the other end of the body 61 is a square socket receptacle 65 defining four flat, planar surfaces 66 and sized for mateably receiving therein the anvil drive lug 46. Formed transversely through the body 61 is a cylindrical bore 67 positioned to pass through the socket receptacle 65 substantially tangent to one of the flat surfaces 66 and closely adjacent to the inner end of the socket receptacle 65 for communication with the groove 47 of the anvil drive lug 60 in the same manner as was described above in connection with the socket tool 50 of FIG. 7. In this case, however, the square drive lug 62 and the socket receptacle 65 are of the same size, so that the socket tool 67 serves to extend the length of the anvil drive lug of 46.

While the present invention has been disclosed as embodied in socket tools provided with drive lugs thereon, it will be appreciated that other types of socket tools could be retained on power tool anvil drive lugs by means of the present invention.

From the foregoing it can be seen that there has been provided an improved apparatus for retaining a socket tool on an anvil drive lug of a power tool which is of simple and economical construction, which provides a permanent or semi-permanent retention and which does not result in any significant weakening of the power tool anvil.

While particular embodiments of the present invention have been shown and described, it will be apparent to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A socket tool comprising: a body having a socket receptacle formed therein, said receptacle being polygonal in transverse cross section and defining a plurality of flat planar surfaces equidistantly spaced from a central axis, and a cylindrical bore having a circumference and extending transversely through said body, the bore being spaced from the axis and communicating with the receptacle at two of said planar surfaces along the entire circumference of the bore.

2. The socket tool of claim 1, wherein said receptacle is square in transverse cross section.

3. The socket tool of claim 1, wherein said receptacle has an inner end, said bore being disposed closely adjacent to said inner end.

4. The socket tool of claim 1, and further comprising a drive lug at one end of said body opposite said socket receptacle.

5. The socket tool of claim 4, wherein said drive lug and said receptacle have the same transverse cross-sectional shape.

6. The socket tool of claim 4, wherein said drive lug and said receptacle have substantially the same size.

7. The socket tool of claim 4, wherein said drive lug and said receptacle are of different sizes.

8. The socket tool of claim 7, wherein said drive lug is larger than said receptacle.

9. The socket tool of claim 4, and further comprising retaining means carried by said drive lug for retaining said drive lug in engagement with an associated female member.

10. The socket tool of claim 1, wherein said bore is substantially tangent to one of said surfaces.

11. In combination: a power impact tool including a drive anvil having an anvil drive lug at one end thereof polygonal in transverse cross section, said anvil drive lug having a peripheral groove formed therein adjacent to a distal end thereof; a socket tool including a body having a socket receptacle formed therein, said receptacle defining a plurality of flat planar surfaces equidistantly spaced from a central axis being shaped and dimensioned to mateably receive said anvil drive lug therein in driving engagement therewith, and a cylindrical bore extending transversely through said body and intersecting said receptacle with the bore spaced from the axis and disposed so as to communicate with said groove when said anvil drive lug is received in said receptacle; and a pin receivable through said bore and having a circumference, said bore being so positioned that when the pin is received through the bore a central portion of the pin has its entire circumference disposed in the receptacle with the central portion being received in said groove for retaining said socket tool on said anvil.

12. The combination of claim 10, wherein said pin is dimensioned to be frictionally fitted in said bore.

13. The combination of claim 10, and further comprising a socket drive lug at one end of said body opposite said socket receptacle.

14. The combination of claim 13, wherein said drive lugs and said receptacle are all substantially square in transverse cross section.

15. The combination of claim 13, wherein said drive lugs are of substantially the same size.

16. The combination of claim 13, wherein said drive lugs are of different sizes.

17. The combination of claim 13, wherein said socket drive lug is larger than said anvil drive lug.

18. The combination of claim 11, wherein said receptacle has an inner end, said bore being disposed closely adjacent to said inner end.

19. The combination of claim 11, wherein said bore is substantially tangent to said one of said surfaces.

* * * * *